US010316455B2

(12) United States Patent
Cinello et al.

(10) Patent No.: US 10,316,455 B2
(45) Date of Patent: Jun. 11, 2019

(54) LAUNDRY WASHING MACHINE EQUIPPED WITH A TREATING AGENTS DISPENSER HAVING WATER SUPPLYING APPARATUS

(71) Applicant: Electrolux Appliances Aktiebolag, Stockholm (SE)

(72) Inventors: Mauro Cinello, Codroipo (UD) (IT); Daniele Da Riol, Cordenons (PN) (IT)

(73) Assignee: Electrolux Appliances Aktiebolag (SE)

( * ) Notice: Subject to any disclaimer, the term of this patent is extended or adjusted under 35 U.S.C. 154(b) by 2 days.

(21) Appl. No.: 15/384,403

(22) Filed: Dec. 20, 2016

(65) Prior Publication Data

US 2017/0183807 A1 Jun. 29, 2017

(30) Foreign Application Priority Data

Dec. 23, 2015 (EP) ..... 15202284

(51) Int. Cl.
*D06F 39/02* (2006.01)
*D06F 37/22* (2006.01)
(Continued)

(52) U.S. Cl.
CPC ..... *D06F 39/028* (2013.01); *D06F 37/22* (2013.01); *D06F 37/304* (2013.01);
(Continued)

(58) Field of Classification Search
None
See application file for complete search history.

(56) References Cited

U.S. PATENT DOCUMENTS 5,685,178 A * 11/1997 Ahn ..... D06F 39/02 134/93
2007/0163307 A1* 7/2007 Kramme ..... D06F 39/02 68/17 R
(Continued)

FOREIGN PATENT DOCUMENTS

DE 3637815 A1 6/1987
DE 19535203 C1 10/1996
(Continued)

OTHER PUBLICATIONS

Extended European Search Report dated Apr. 1, 2016 issued in corresponding European Application No. 15202284.4.

*Primary Examiner* — Jason Y Ko
*Assistant Examiner* — Cristi J Tate-Sims
(74) *Attorney, Agent, or Firm* — RatnerPrestia

(57) ABSTRACT

A laundry washing machine (1) is equipped with a treating agents dispenser (20) that includes at least one compartment (23*a*, 23*b*, 23*c*, 23*d*) adapted to be filled with at least one treating agent. The compartment (23*a*, 23*b*, 23*c*, 23*d*) has a bottom part (62*a*, 62*b*, 62*c*, 62*d*) and a side wall (63*a*, 63*b*, 63*c*, 63*d*) rising from the bottom part (62*a*, 62*b*, 62*c*, 62*d*). The side wall (63*a*, 63*b*, 63*c*, 63*d*) superiorly defines a top boundary line (263*a*, 263*b*, 263*c*, 263*d*). At least one water conveying line (120*a*, 120*b*, 120*c*, 120*d*) conveys water to the at least one compartment (23*a*, 23*b*, 23*c*, 23*d*). The at least one water conveying line (120*a*, 120*b*, 120*c*, 120*d*) includes outlets (29*a*, 29*b*, 29*c*, 29*d*) facing the at least one compartment (23*a*, 23*b*, 23*c*, 23*d*) and the outlets (29*a*, 29*b*, 29*c*, 29*d*) are aligned along a path (273*a*, 273*b*, 273*c*, 273*d*) which is at least partially adjacent to the top boundary line (263*a*, 263*b*, 263*c*, 263*d*).

13 Claims, 14 Drawing Sheets

(51) Int. Cl.
*D06F 37/30* (2006.01)
*D06F 39/00* (2006.01)

(52) U.S. Cl.
CPC ..... *D06F 39/005* (2013.01); *D06F 39/02* (2013.01); *D06F 39/022* (2013.01)

(56) References Cited

U.S. PATENT DOCUMENTS

| | | | | |
|---|---|---|---|---|
| 2008/0235880 | A1* | 10/2008 | Kim | D06F 39/022 8/137 |
| 2010/0018258 | A1* | 1/2010 | Cho | D06F 39/02 68/17 R |
| 2012/0060568 | A1* | 3/2012 | Buso | D06F 39/02 68/17 R |

FOREIGN PATENT DOCUMENTS

| | | | |
|---|---|---|---|
| EP | 2078779 | A1 | 7/2009 |
| GB | 2215348 | A | 9/1989 |
| WO | 03006731 | A1 | 1/2003 |
| WO | 2015063005 | A1 | 5/2015 |

* cited by examiner

LAUNDRY WASHING MACHINE EQUIPPED WITH A TREATING AGENTS DISPENSER HAVING WATER SUPPLYING APPARATUS

CROSS-REFERENCE TO RELATED APPLICATION

This application claims priority to European Application No. 15202284.4 filed Dec. 23, 2015, the content of which is hereby incorporated by reference in its entirety.

BACKGROUND

The present invention concerns the field of laundry washing techniques.

In particular, the present invention relates to a treating agents dispenser in a laundry washing machine.

Nowadays the use of laundry washing machines, both "simple" laundry washing machines (i.e. laundry washing machines which can only wash and rinse laundry) and laundry washing-drying machines (i.e. laundry washing machines which can also dry laundry), is widespread.

In the present description the term "laundry washing machine" will refer to both simple laundry washing machines and laundry washing-drying machines.

Laundry washing machines generally comprise an external casing, or cabinet, provided with a washing tub which contains a rotatable perforated drum where the laundry is placed. A loading/unloading door ensures access to the drum.

Laundry washing machines typically comprise a water supply unit and a products supply unit, or dispenser, for the introduction of water and treating agents (i.e. detergent, softener, rinse conditioner, etc.) into the tub. The treating agents dispenser is advantageously connected to a water source (water main).

Known treating agents dispensers comprise one or more compartments having bottom and side walls adapted to be filled with at least one treating agent and one or more respective water conveying lines for conveying water to the compartments.

Water conveying lines are typically realized in a water distributor placed above the compartments. The water distributor is opportunely shaped to define ducts provided with apertures allowing water coming from the water main to fall down in the underlying compartments.

A drawback posed by the treating agents dispensers of the known art and/or the laundry washing machines having such dispenser lies in that residues of treating agent, especially powder treating agent, often stick to compartment walls, more often at the side walls of the compartment. Residues of treating agent may accumulate and may form a sticky, gelatinous mass, which will ultimately adhere to the walls of the compartment.

Another drawback posed by the treating agents dispensers of the known art is that the accumulation of treating agent may favour the proliferation of bacteria, which may then worsen the hygienic conditions and may cause bad smells.

The object of the present invention is therefore to overcome the drawbacks posed by the known technique.

It is a first object of the invention to provide a laundry washing machine that makes it possible to reduce or prevent residues of treating agent from adhering on the walls of compartments of the treating agents dispensers.

It is another object of the invention to provide a laundry washing machine that makes it possible to reduce proliferation of bacteria therefore improving hygienic conditions.

SUMMARY OF SELECTED INVENTIVE ASPECTS

The applicant has found that by providing a laundry washing machine equipped with a treating agents dispenser having at least one compartment receiving the treating agent wherein a water conveying line conveys water to the compartment and by providing the water conveying line with outlets which direct the water tangentially to the side wall of the compartment, it is possible to overcome drawbacks of known techniques.

In an aspect, the present invention relates, therefore, to a laundry washing machine comprising:

a) a cabinet supporting a washing drum adapted to receive laundry and a washing tub external to said washing drum;

b) a treating agents dispenser comprising:

at least one compartment adapted to be filled with at least one treating agent, said compartment comprising a bottom part and a side wall rising from said bottom part, said side wall superiorly defining a top boundary line;

at least one water conveying line for conveying water to said at least one compartment;

c) a supply line, fluidly connecting said treating agents dispenser and said washing tub;

d) a control unit for controlling functioning of said laundry washing machine;

wherein said at least one water conveying line comprises outlets facing said at least one compartment, said outlets being aligned along a path which is at least partially adjacent to said top boundary line.

In a preferred embodiment of the invention, the outlets are aligned along the path so that the water falling into the compartment touches the side wall and then flows towards its bottom part.

Preferably, the outlets are aligned along the path so that the water falls into the compartment along a water direction which tangentially follows the side wall of the compartment.

Preferably, the water direction has a horizontal component which tangentially follows the side wall.

Preferably, the water direction has a horizontal component which is parallel to the side wall.

According to a preferred embodiment of the invention, the water direction has a substantially vertical component which tangentially follows the side wall.

Preferably, the vertical component of the water direction is substantially parallel to the side wall.

In a preferred embodiment of the invention, the water direction of the water exiting one of the outlets has a horizontal component which is parallel to the horizontal direction of the top boundary line at the point of the top boundary line closest to said one outlet.

Preferably, the outlets are realized along a portion of a duct which defines said at least one water conveying line.

Preferably, the portion of duct extends along the path which is at least partially adjacent to the top boundary line.

According to a preferred embodiment of the invention, at least one of the outlets comprises an inclined upstream portion.

The term "upstream" is referred to the water flowing direction inside the water conveying line during the functioning of the water dispenser.

In a preferred embodiment of the invention, each of said outlets comprises an inclined upstream portion.

The inclined upstream portion preferably diverges from the axis of the duct.

Opportunely, the distance of the inclined upstream portion from the axis of the duct increases while moving in the water flowing direction.

Preferably, the side wall of the compartment is vertical or substantially vertical, with the dispenser in its operating position in the laundry washing machine.

Also preferably, the compartment comprises at least one curved portion.

With the term "curved" it is meant that by sectioning the side wall portion with a plane parallel to the horizontal plane the resulting section is a curve.

According to a preferred embodiment of the invention, the outlets of the at least one water conveying line are arranged along so that at least a quantity of water exiting the outlets is directed towards the curved portion.

In a preferred embodiment of the invention, the water conveying line is connectable to a water source through a controllable valve.

Preferably, the water conveying line comprises an air-break.

BRIEF DESCRIPTION OF THE DRAWINGS

Further characteristics and advantages of the present invention will be highlighted in greater detail in the following detailed description of a preferred embodiment of the invention, provided with reference to the enclosed drawings. In the drawings, corresponding characteristics and/or components are identified by the same reference numbers. In such drawings.

DETAILED DESCRIPTION OF EXAMPLE EMBODIMENTS

Figure 2:
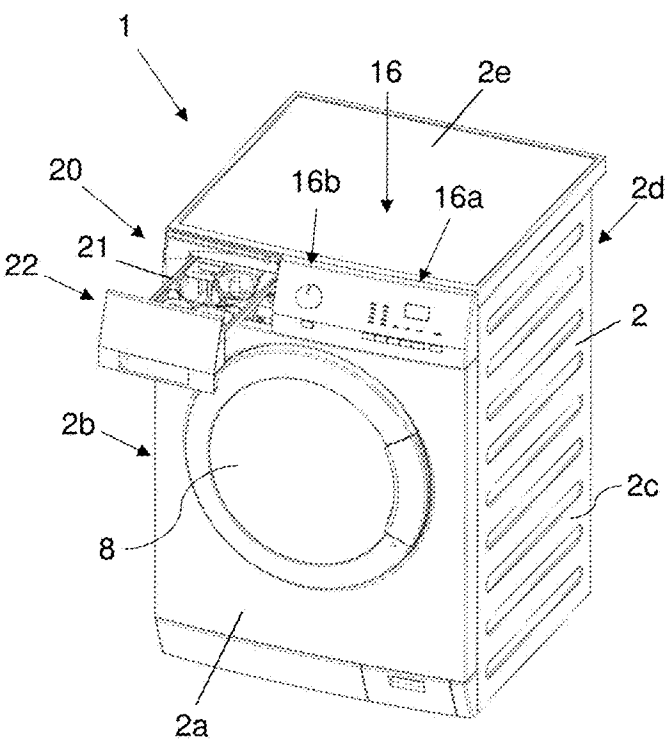
FIG. 2 shows the laundry washing machine of FIG. 1 with the drawer in its opened loading position.

Aspects of the present invention have proved to be particularly advantageous when applied to laundry washing machines, as described below. It should in any case be underlined that the present invention is not limited to laundry washing machines. On the contrary, the present invention can be conveniently applied to laundry washing-drying machines (i.e. laundry washing machines which can also dry laundry).

In the present description, therefore, the term "laundry washing machine" will refer to both simple laundry washing machines and laundry washing-drying machines.

A laundry washing machine 1 equipped with a treating agents dispenser according to a preferred embodiment of the invention is described with reference to FIGS. 1 to 14.

The laundry washing machine 1 comprises an external casing or cabinet 2, in which a washing tub 3 is provided that contains a perforated washing drum 4 where the laundry to be treated can be loaded. The external casing 2 comprises vertical side walls 2*a*-2*d* and an upper side wall 2*e*.

The tub 3 and the drum 4 both preferably have a substantially cylindrical shape. Between the tub 3 and the drum 4 a gap is defined.

The cabinet 2 is provided with a loading/unloading door 8 which allows access to the drum 4.

The tub 3 is preferably suspended in a floating manner inside the cabinet 2, advantageously by means of a number of coil springs and shock-absorbers 17.

The drum 4 is advantageously rotated by an electric motor 9 which preferably transmits the rotating motion to the shaft of the drum 4, advantageously by means of a belt/pulley system 9*a*. In a different embodiment of the invention, the motor can be directly associated with the shaft of the drum 4.

The drum 4 is advantageously provided with holes which allow the liquid flowing therethrough. Said holes are typically and preferably homogeneously distributed on the cylindrical side wall of the drum 4.

The tub 3 is preferably connected to the cabinet 2 by means of an elastic bellows 7, or gasket. The bellows 7 is preferably S-shaped.

Figure 3:
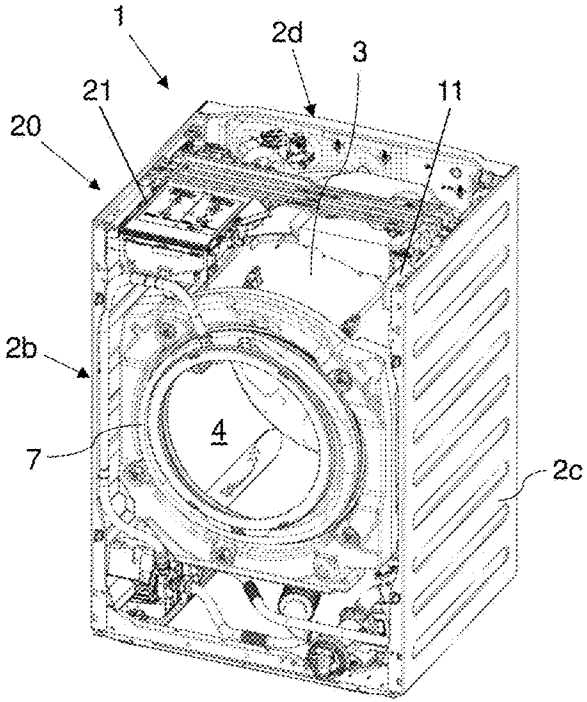
FIG. 3 shows the laundry washing machine of FIG. 1 with the front side wall and the upper side wall removed.

Laundry washing machine 1 advantageously comprises a control unit 11, for example illustrated in FIG. 3, connected to the various parts of the laundry washing machine 1 in order to ensure its operation. Laundry washing machine 1 preferably comprises an interface unit 16, connected to the control unit 11, accessible to the user and by means of which the user may select and set the washing parameters, like for example a desired washing program. Usually, other parameters can optionally be inserted by the user, for example the washing temperature, the spinning speed, etc. The interface unit 16 preferably comprises a display 16*a* which displays machine working conditions.

The unit interface 16 then preferably comprises one or more selector devices which allow to select the appropriate washing program and/or to set other parameters.

For example, the selector devices may comprise a selector 16*b* (a rotary knob) which advantageously allows to select the appropriate washing program. The selector devices may then preferably comprise push buttons.

In further embodiments, the selector devices may comprise other of type device, such as capacitive switch, touch screen, etc. In a preferred embodiment, the touch screen may coincide with the display 16*a*.

The laundry washing machine 1 advantageously comprises a treating agents dispenser 20 to supply treating agents into the tub 3 during a washing cycle. Treating agents may comprise, for example, detergents, rinse additives, fabric softeners or fabric conditioners, waterproofing agents, fabric enhancers, rinse sanitization additives, chlorine-based additives, etc.

Advantageously, the treating agents dispenser 20 comprises a box-shaped housing 21, connected to the external casing 2, internally to the latter, preferably by suitable fixing means, comprising, for example, screws or rivets, not illustrated, or also glue, or welding.

In the enclosed Figures, the housing 21 is advantageously substantially parallelepiped, and it is connected to the frontal side wall 2*a* of the external casing 2, opportunely in an upper region of the latter, positioned above the tub 3.

Figure 1:
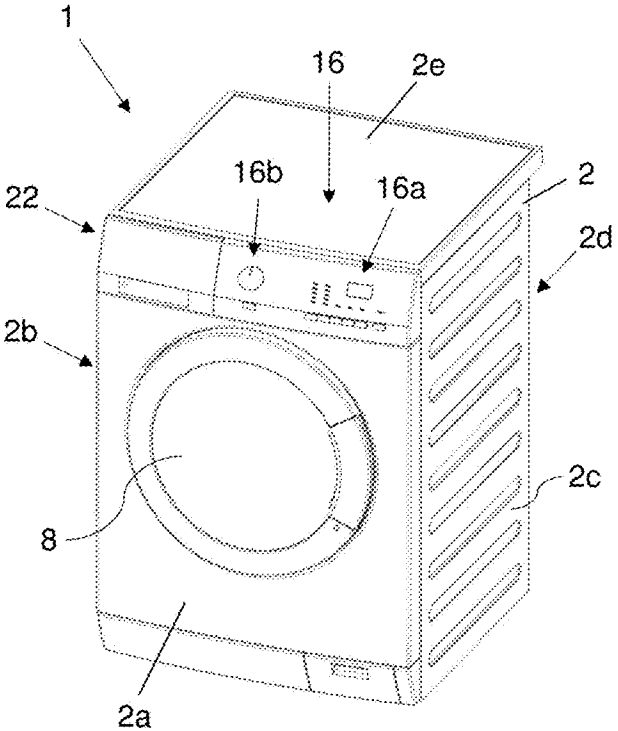
FIG. 1 shows a perspective view of a laundry washing machine equipped with a treating agents dispenser according to a preferred embodiment of the invention.
Figure 5:
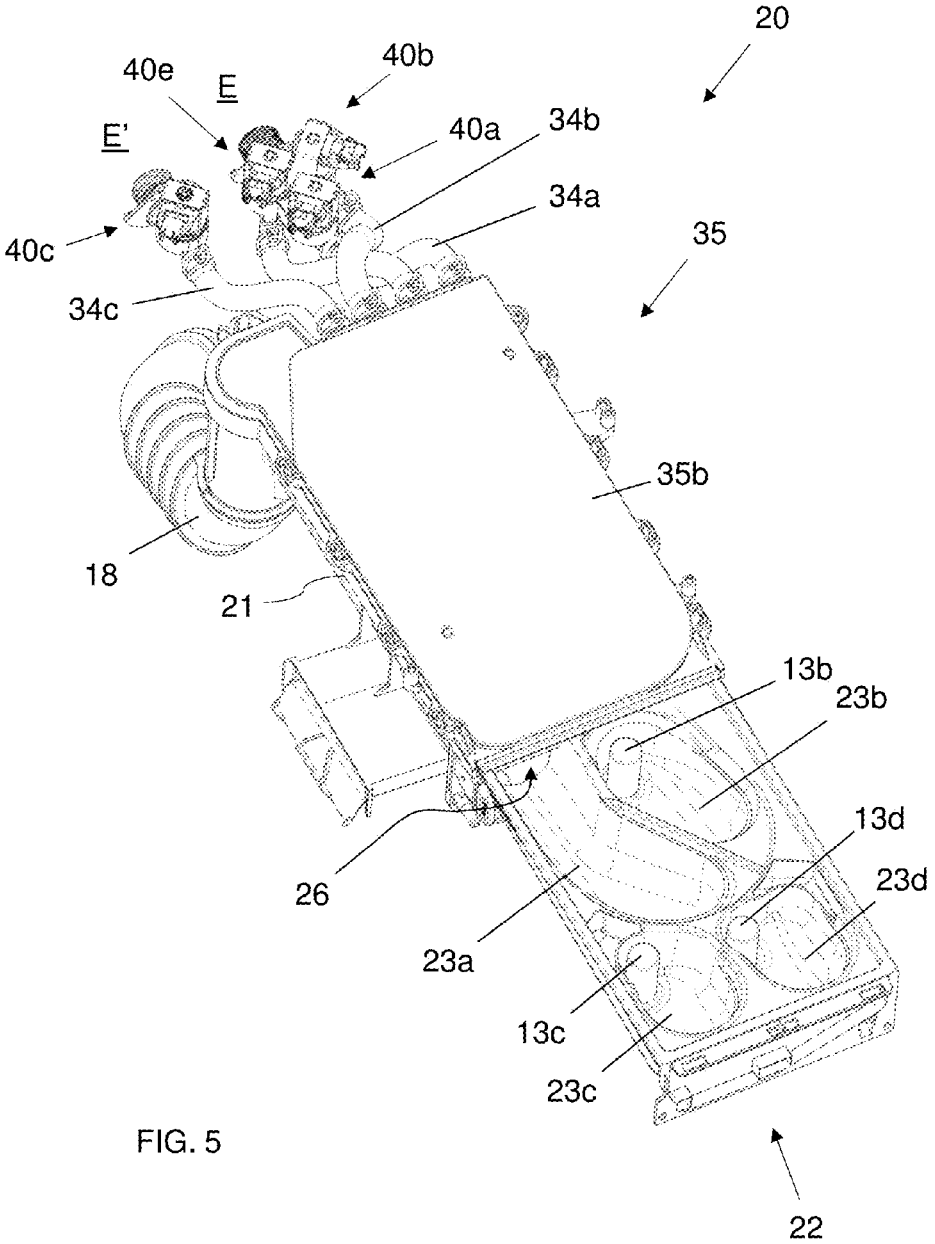
FIG. 5 is a perspective view of the treating agents dispenser, isolated from the rest, of the laundry washing machine represented in FIG. 2 with the drawer in its opened loading position.
Figure 6:
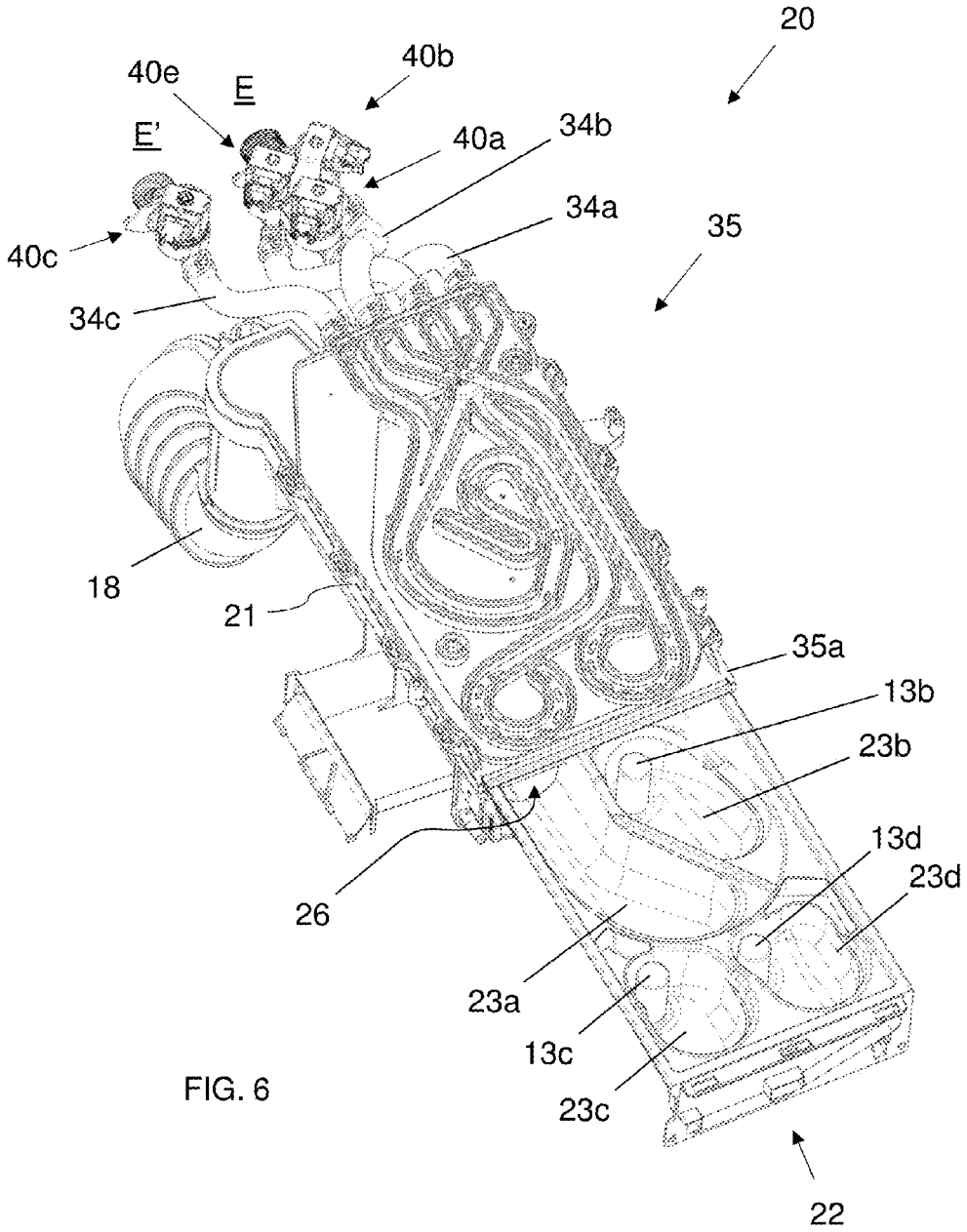
FIG. 6 shows the treating agents dispenser of FIG. 5 with an element removed therefrom.
Figure 7:
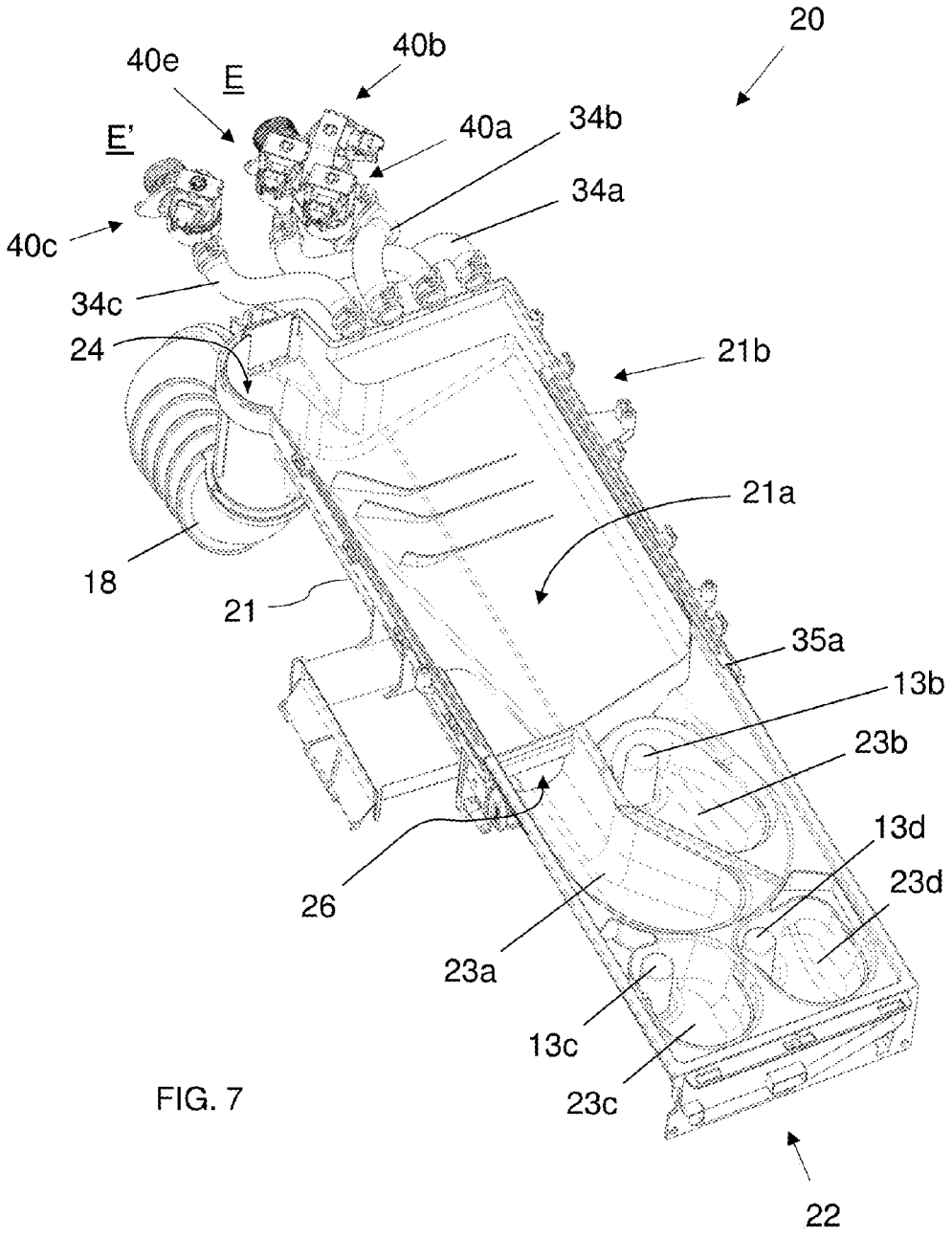
FIG. 7 shows the treating agents dispenser of FIG. 6 with a further element removed therefrom.
Figure 9:
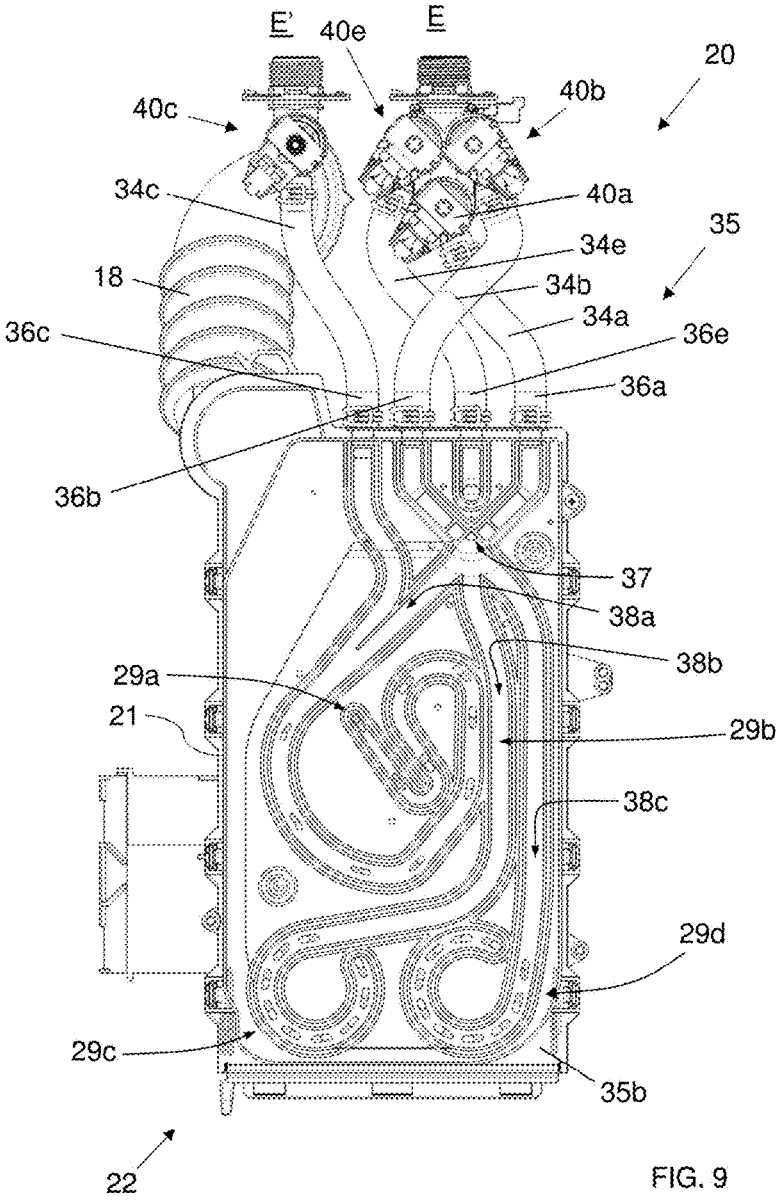
FIG. 9 is a plan view of the treating agents dispenser of FIG. 6 with the drawer in its closed position.

The housing 21 contains a removable drawer 22 which can be extracted from the housing 21, such as to protrude from the external casing 2 in a opened loading position, as illustrated for example in FIGS. 2 and 5, or can be fully inserted into the housing 21 in an operative position, as illustrated for example in FIGS. 1 and 9.

The drawer 22 is preferably provided with one or more compartments 23*a*, 23*b*, 23*c*, 23*d* adapted to be filled with treating agents.

In the embodiment illustrated in the Figures, there are four compartments, 23*a*, 23*b*, 23*c* and 23*d*.

In different embodiments, not illustrated, the number of compartments may be different, according to the desired type and number of treating agents which are used in the particular model of laundry washing machine.

The first compartment 23*a* is preferably adapted for receiving a powder detergent; the second compartment 23*b* is preferably adapted for receiving a quantity of liquid detergent; the third compartment 23*c* is preferably adapted for receiving a softener; the fourth compartment 23*d* is preferably adapted for receiving other treating agents, such as fabric conditioners, waterproofing agents, fabric enhancers, rinse sanitization additives, chlorine-based additives, etc.

The compartments 23*a*, 23*b*, 23*c* and 23*d* are fluidly connected to the bottom 21*a* of the housing 21, particularly to the rear portion 21*b* of this bottom 21*a*, in which an outlet port 24 is obtained. The outlet port 24 is adapted to allow the flowing of a liquid into a supply pipe 18 fluidly connecting the treating agents dispenser 20 and the tub 3, as visible in FIGS. 4 and 8.

It is underlined that in the present application saying that a first component is "fluidly connected" to a second component means that a fluid can flow from the first component to the second component and vice versa; on the contrary, saying that a first component is "fluidly separated" from a second component means that a fluid can't flow from the first component to the second component or vice versa.

Figure 4:
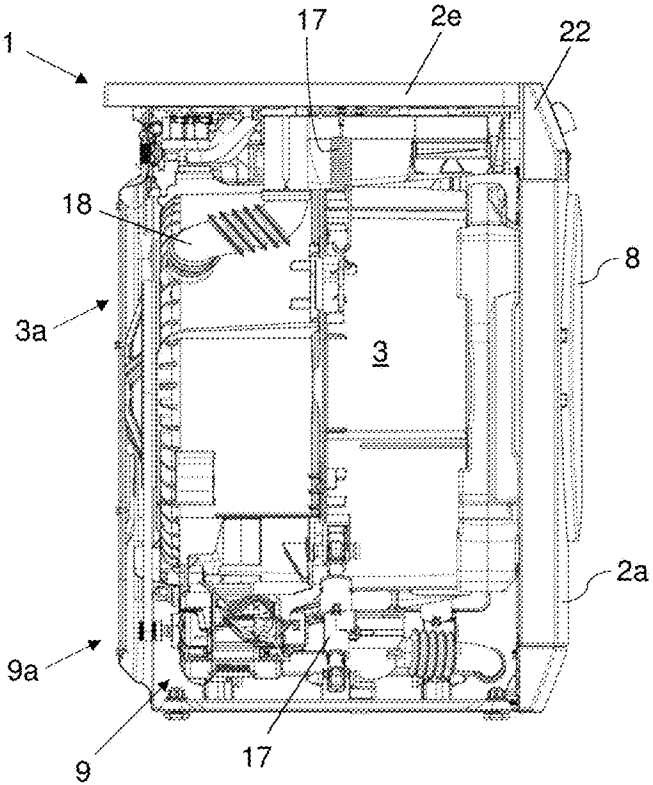
FIG. 4 shows a lateral plan view of the laundry washing machine of FIG. 1 with the left side wall removed.

The supply pipe 18, as illustrated in FIG. 4, is preferably arranged laterally with respect to the tub 3 and preferably terminates at an upper region 3*a* of the tub 3. More preferably, the supply pipe 18 terminates at a rear side of the tub 3.

The bottom 21*a* of the housing 21 preferably has a sloped bottom wall so that a fluid may flow towards the outlet port 24. The outlet port 24 is preferably located at the rear of the sloped bottom wall 21*a*.

The first compartment 23*a* of the drawer 22 is fluidly connected to the bottom 21*a* of the housing 21 through an aperture 26 defined at the rear of the first compartment 23*a*.

Figure 8:
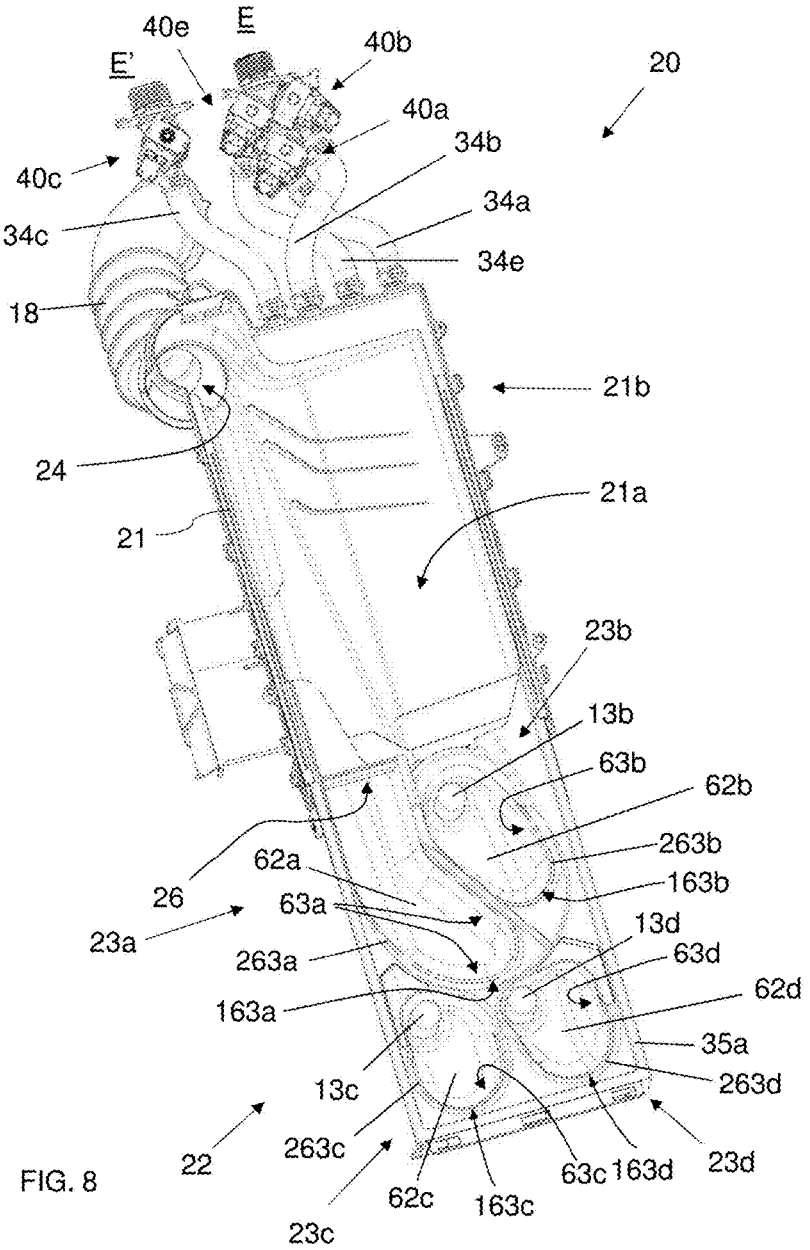
FIG. 8 shows the treating agents dispenser of FIG. 7 from a slightly different point of view.

The first compartment 23*a* preferably comprises a sloped bottom part 62*a* so that a fluid may flow towards the aperture 26, as illustrated in FIG. 8. The aperture 26 is located at the rear of the sloped bottom part 62*a*. The first compartment 23*a* then preferably comprises a substantially vertical side wall 63*a* rising from the bottom part 62*a*.

The term "vertical" refers to the normal operating position of the dispenser with the laundry washing machine 1 installed on the floor.

Superiorly, the vertical side wall 63*a* defines a top boundary line 263*a*.

According to an advantageous aspect of the invention, the side wall 63*a* of the first compartment 23*a* preferably comprises at least a portion 163*a* which is curved. With the term "curved" it is meant that by sectioning the side wall portion 163*a* with a plane parallel to the horizontal plane, for example the horizontal plane defined by the sheet of FIG. 8, the resulting section is a curve.

In the preferred embodiment here illustrated, the curved portion 163*a* is substantially circular. The other portions of the substantially vertical side wall 63*a* comprises linear or substantially linear portions which extend up to the rear aperture 26.

The curved portion 163*a*, as better described below, gives an advantageous effect to the functioning of the treating agents dispenser 20.

The other compartments 23*b*, 23*c* and 23*d* of the drawer 22 are preferably fluidly connected to the bottom 21*a* of the housing 21 through respective siphons 13*b*, 13*c*, 13*d*.

Analogously to the first compartment 23*a*, the other compartments 23*b*, 23*c* and 23*d* preferably comprise respective bottom parts 62*b*, 62*c* and 62*d* and substantially vertical side walls 63*b*, 63*c* and 63*d* rising from the respective bottom parts 62*b*, 62*c* and 62*d*. In particular, side walls 63*b*, 63*c* and 63*d* surround the respective bottom parts 62*b*, 62*c* and 62*d*.

Superiorly, the vertical side walls 63*b*, 63*c* and 63*d* defines respective top boundary lines 263*b*, 263*c* e 263*d*.

According to an advantageous aspect of the invention, the substantially vertical side walls 63*b*, 63*c* and 63*d* of the compartments 23*b*, 23*c* and 23*d* preferably have at least a portion 163*b*, 163*c* and 163*d* which is curved, with the term "curved" defined as above.

In the preferred embodiment here illustrated, all the curved portions 163*b*, 163*c* and 163*d* are substantially circular. The other portions of the substantially vertical side wall 163*b*, 163*c* and 163*d* are mixtilinear, namely a combination of linear and curved wall portions which surround the bottom parts 62*b*, 62*c* and 62*d* and the siphons 13*b*, 13*c*, 13*d*.

The curved portions 163*b*, 163*c* and 163*d*, as better described below, give an advantageous effect to the functioning of the treating agents dispenser 20.

Preferably, the treating agents dispenser 20 comprises a water distributor 35, associated to the housing 21 and placed above the drawer 22 in such a way to allow the flowing of water to one or more of said compartments 23*a*, 23*b*, 23*c*, 23*d*.

The treating agents dispenser 20 comprises one or more water conveying lines 120*a*, 120*b*, 120*c*, 120*d* adapted for conveying water to one or more of said compartments 23*a*, 23*b*, 23*c*, 23*d*.

The water distributor 35 preferably comprises a lower part 35*a* and an upper closing part 35*b* structured for being reciprocally coupled to form the water distributor 35. The two parts 35*a*, 35*b* are preferably coupled by welding and/or glueing and/or joint.

Advantageously, the water distributor 35 comprises a first and a second inlet connector 36*a*, 36*b* connectable to a water source E which could comprise, for example, the plumbing of the building in which the laundry washing machine 1 is installed, as better visible in FIG. 9.

Advantageously the first and second connectors 36*a*, 36*b* can be connected to the water source E via first and second controllable valves 40*a*, 40*b*, preferably of the electromagnetic type, opportunely controlled by the control unit 11. In the embodiment illustrated in the enclosed Figures, the two inlet connectors 36*a*, 36*b* can be connected via the dedicated controllable valves 40*a*, 40*b*, to the water source E for the adduction of cold water.

Inlets of the two controllable valves 40*a*, 40*b* are connectable to the water source E and outlets of the two controllable valves 40*a*, 40*b* are connected, through respective pipes 34*a*, 34*b*, to the two inlet connectors 36*a*, 36*b* of the water distributor 35.

Preferably, the controllable valves 40*a*, 40*b* above described, and all the valves described hereinafter, comprise a regulator system that automatically cuts off the flow of water flowing therethrough at a certain maximum pressure. Preferably, the maximum pressure is set at a value comprises between 1, 7 and 2, 4 bar.

In the embodiment illustrated in the enclosed Figures there is also provided a third inlet connector 36*c* connectable, via a third controllable valve 40*c*, to a warm or hot water source E' (as visible in FIG. 9); the further inlet connector 36*c* can be fed with warm or hot water, for example obtained by a solar thermal collector; in a further embodiment, not illustrated, there could be more than one further inlet connectors, connected to one or more water sources.

Inlet of the third controllable valve 40*c* is connectable to the water source E' and outlet of the third controllable valve 40*c* is connected, through a respective pipe 34*c*, to the third inlet connector 36*c* of the water distributor 35.

Three ducts 38*a*, 38*b*, 38*c* are fluidly connected to the inlet connectors 36*a*, 36*b*.

Preferably, the inlet connectors 36*a*, 36*b* and the three ducts 38*a*, 38*b*, 38*c* are connected through a so called "air-break" 37, that is a safety system comprising an opening obtained in the water path in such a way to ensure that a stream of water can flow from the inlet connectors 36*a*, 36*b* to the three ducts 38*a*, 38*b*, 38*c* due to the water source pressure, while water can't flow from the ducts 38*a*, 38*b*, 38*c* to the inlet connectors 36*a*, 36*b*. In the embodiment illustrated, the "air-break" 37 advantageously comprises a lower opening 37*a*, better visible in FIG. 11.

Each one of said three ducts 38*a*, 38*b*, 38*c* are opportunely shaped so as to define said water conveying lines 120*a*, 120*b*, 120*c*, 120*d*, as better described below, which fluidly communicate with a different region 25*a*, 25*b*, 25*c*, 25*d* of the water distributor 35 and, finally, adapted for conveying water to one or more of said compartments 23*a*, 23*b*, 23*c*, 23*d*.

Each region 25*a*, 25*b*, 25*c*, 25*d* is opportunely displaced in such a way to be placed above a respective compartment 23*a*, 23*b*, 23*c*, 23*d* of the drawer 22 when the latter is placed in its closed operative position.

The water conveying lines 120*a*, 120*b*, 120*c*, 120*d* are provided with outlets 29*a*, 29*b*, 29*c*, 29*d* facing the underlying compartments 23*a*, 23*b*, 23*c*, 23*d* that allow the passage of the water from the water distributor 35 to the underlying compartments 23*a*, 23*b*, 23*c*, 23*d*, as better described below.

More particularly, said outlets 29*a*, 29*b*, 29*c*, 29*d* are realized along a portion of said ducts 38*a*, 38*b*, 38*c*.

With reference to ducts 38*a*, 38*b*, 38*c*, they are advantageously defined between the lower part 35*a* and the upper closing part 35*b* of the water distributor 35.

In particular, as will be better explained in the following, by acting on the controllable valves 40*a*, 40*b* and 40*c*, it is possible to selectively feed one of the ducts 38*a*, 38*b* and 38*c* and hence one or more water conveying lines 120*a*, 120*b*, 120*c*, 120*d* with water coming from the water source E or E'.

Figure 9B:
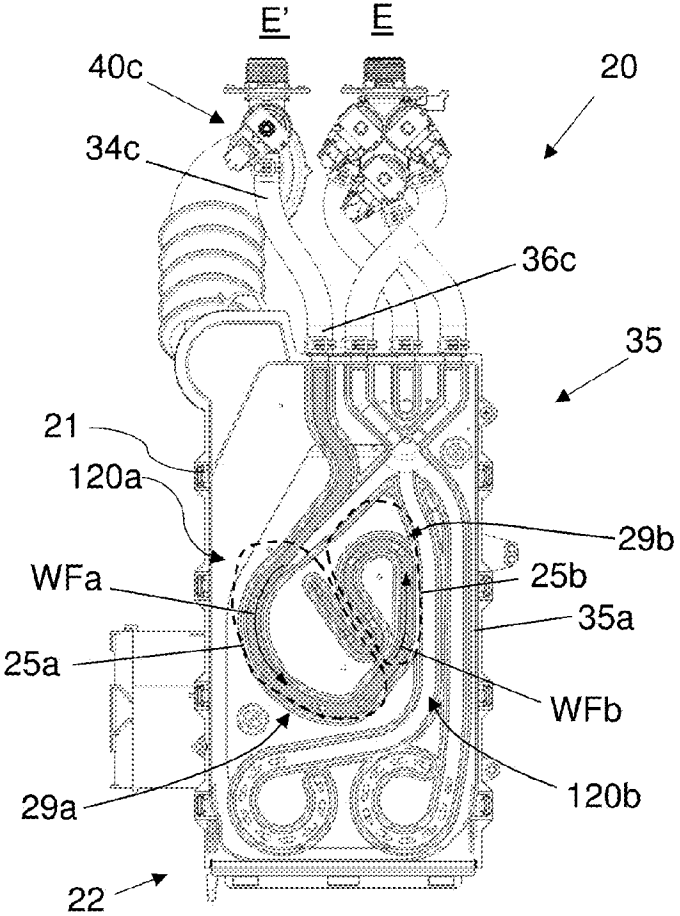
FIGS. 9A to 9D schematically illustrate different working conditions of the treating agents dispenser of FIG. 9.
Figure 9A:
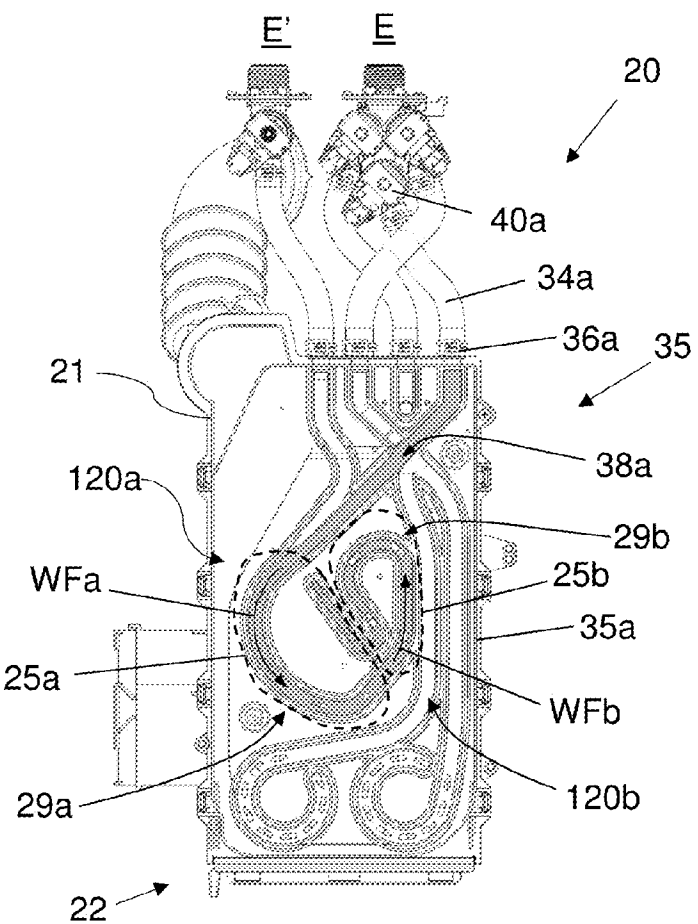

More in particular, the first duct 38*a* supplies the first and second water conveying lines 120*a*, 120*b* and therefore the two regions 25*a*, 25*b* of the water distributor 35 which are positioned above the first and second compartments 23*a*, 23*b*, as indicated in FIG. 9A.

Water is conveyed to the two compartments 23*a*, 23*b* of the drawer 22 by activating the first valve 40*a* and making the water flowing through the first duct 38*a* and the first and second water conveying lines 120*a*, 120*b* up to the regions 25*a*, 25*b*, as schematically indicated in FIG. 9A with grey path. In FIG. 9A, also the direction WFa, WFb of the water flowing in the first and second water conveying lines 120*a*, 120*b* are depicted.

In the embodiment illustrated in the enclosed Figures also the further connector 36*c*, which can be fed with warm or hot water, is fluidly connected to the two regions 25*a*, 25*b* of the water distributor 35, in such a way to adduct also warm or hot water in the underlying first and second compartments 23*a*, 23*b* through the first and second water conveying lines 120*a*, 120*b*, as schematically indicated in FIG. 9B.

In a further preferred embodiment, not illustrated, the water distributor may comprise a dedicated duct and valve for each compartment, i.e. a duct communicating with the first region (first water conveying line) and another duct communicating with the second region (second water conveying line).

The second duct 38*b* supplies the third water conveying lines 120*c* and therefore the third region 25*c* of the water distributor 35 which is positioned above the third compartment 23*c*.

Figure 9D:
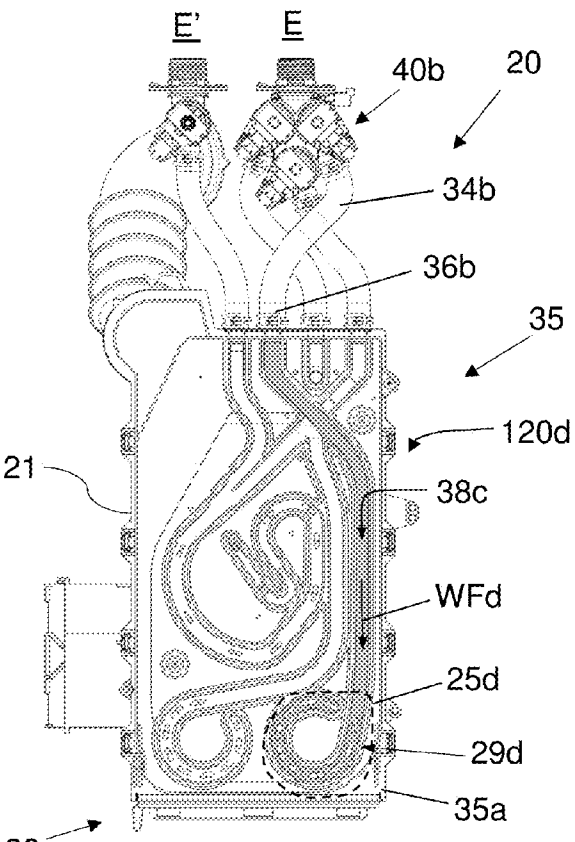
Figure 9C:
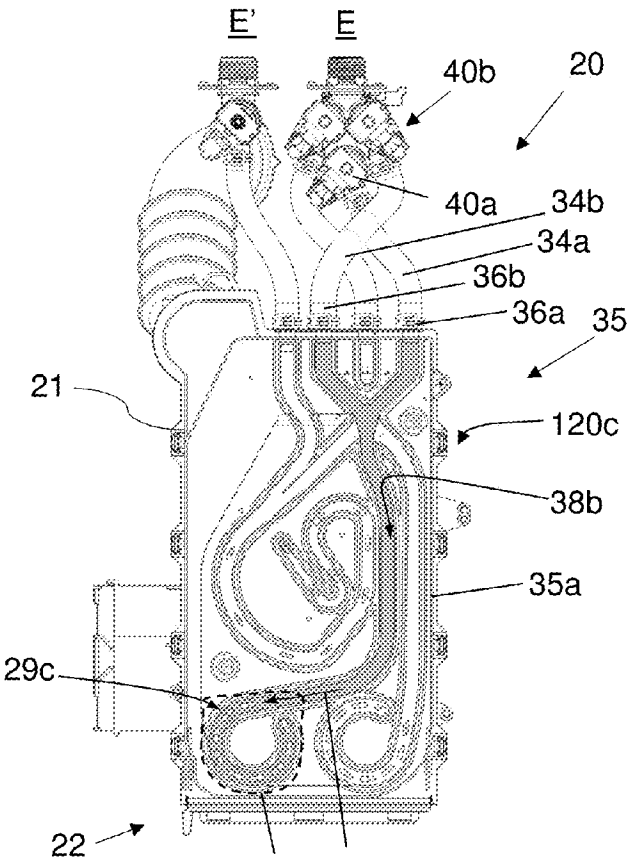
Figure 10:
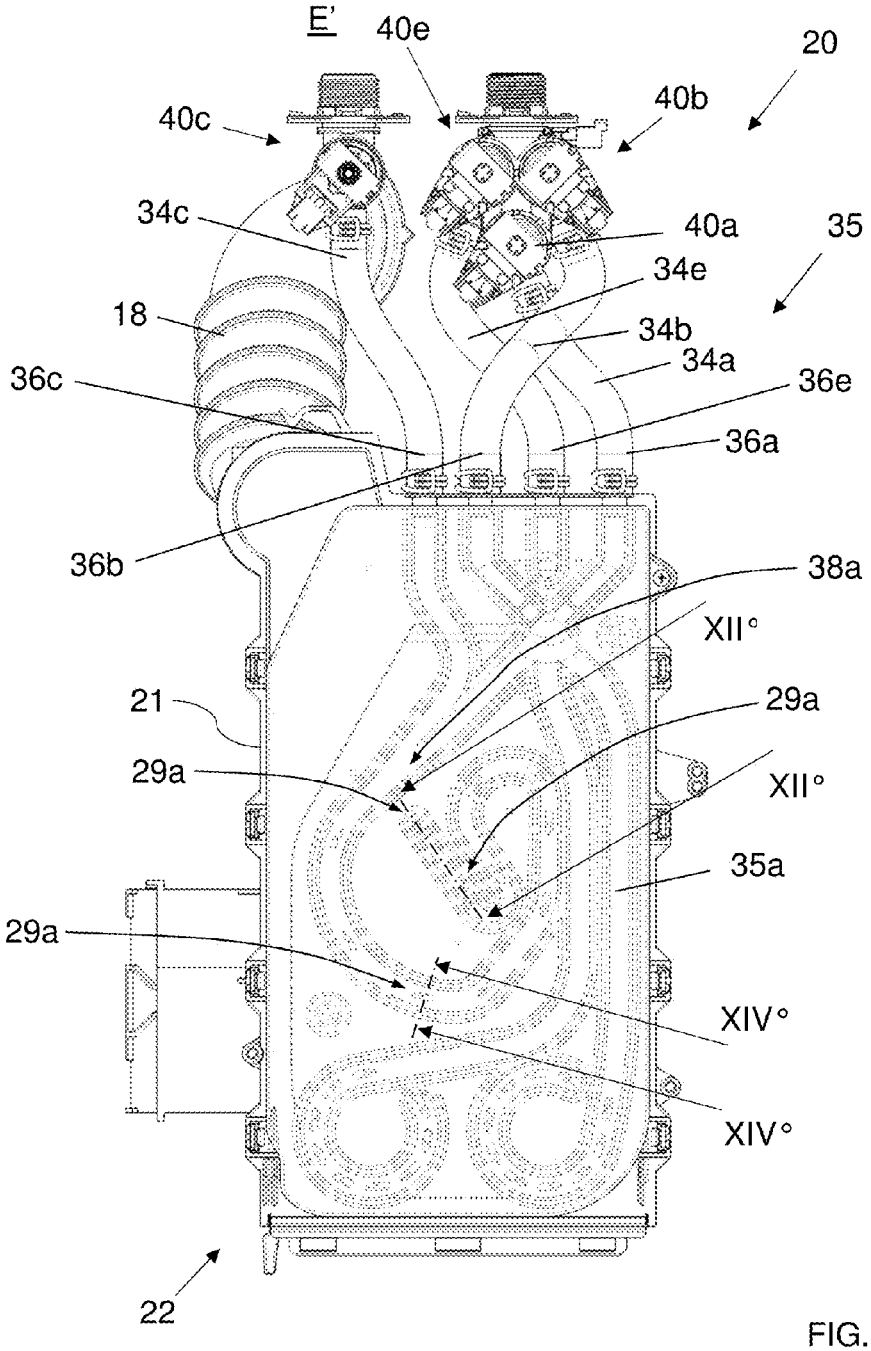
FIG. 10 is a plan view of the treating agents dispenser of FIG. 5 with the drawer in its closed position in which the underlying not visible components have been represented in dotted lines.

Water is conveyed to the third compartment 23*c* of the drawer 22 by activating simultaneously the first and second valves 40*a*, 40*b* and making the water flowing through the second duct 38*b* and the third water conveying line 120*c* up to the third region 25*c*, as schematically indicated in FIG. 9C. In FIG. 9C, also the direction WFc of the water flowing in the third water conveying line 120*c* is depicted.

The third duct 38*c* supplies the fourth water conveying line 120*d* and therefore the fourth region 25*d* of the water distributor 35 which is positioned above the fourth compartment 23*d*.

Water is conveyed to the fourth compartment 23*d* of the drawer 22 by activating the second valve 40*b* and making the water flowing through the third duct 38*c* and the fourth water conveying line 120*d* up to the fourth region 25*d*, as schematically indicated in FIG. 9D. In FIG. 9D, also the direction WFd of the water flowing in the fourth water conveying line 120*d* is depicted.

In another embodiment, not illustrated, in the drawer there can be more than four compartments, and in the water distributor there can be more than three ducts, each one fluidly communicating with a different region of the water distributor which is positioned in such a way to be placed above a different compartment of the drawer when the latter is placed in its closed operative position; also in this case, by acting on the controllable valves, it is possible to selectively feed a desired duct with water coming from the water source.

In further embodiments, not illustrated, in the drawer there can be less than four compartments, even just one, and in the water distributor there can be less than three ducts, each one fluidly communicating with a different region of the water distributor which is positioned in such a way to be placed above a different compartment of the drawer when the latter is placed in its closed operative position; also in this case, by acting on the controllable valves, it is possible to selectively feed a desired duct with water coming from the water source.

Figure 11:
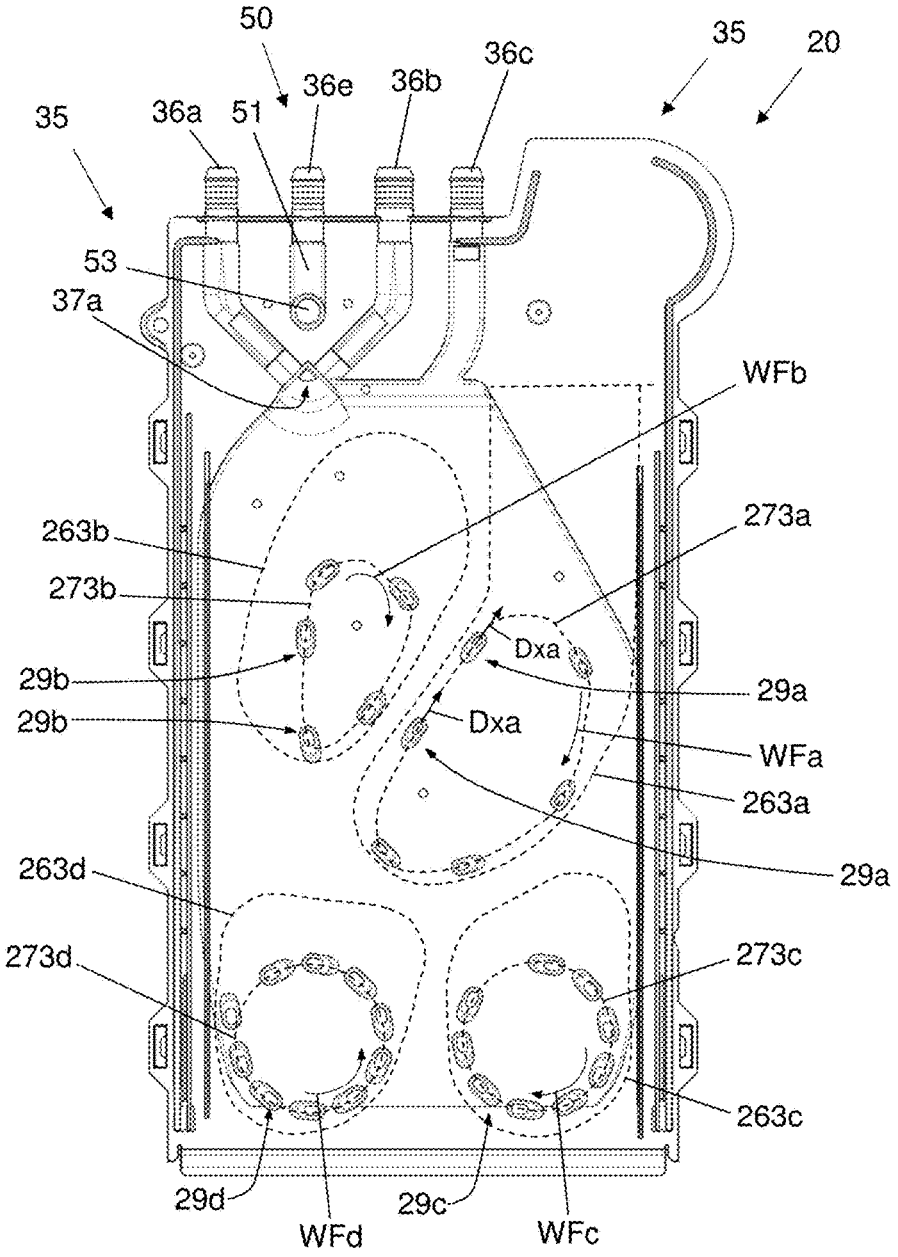
FIG. 11 shows a plan view, from below, of the upper part of the treating agents dispenser of FIG. 5.
Figure 11A:
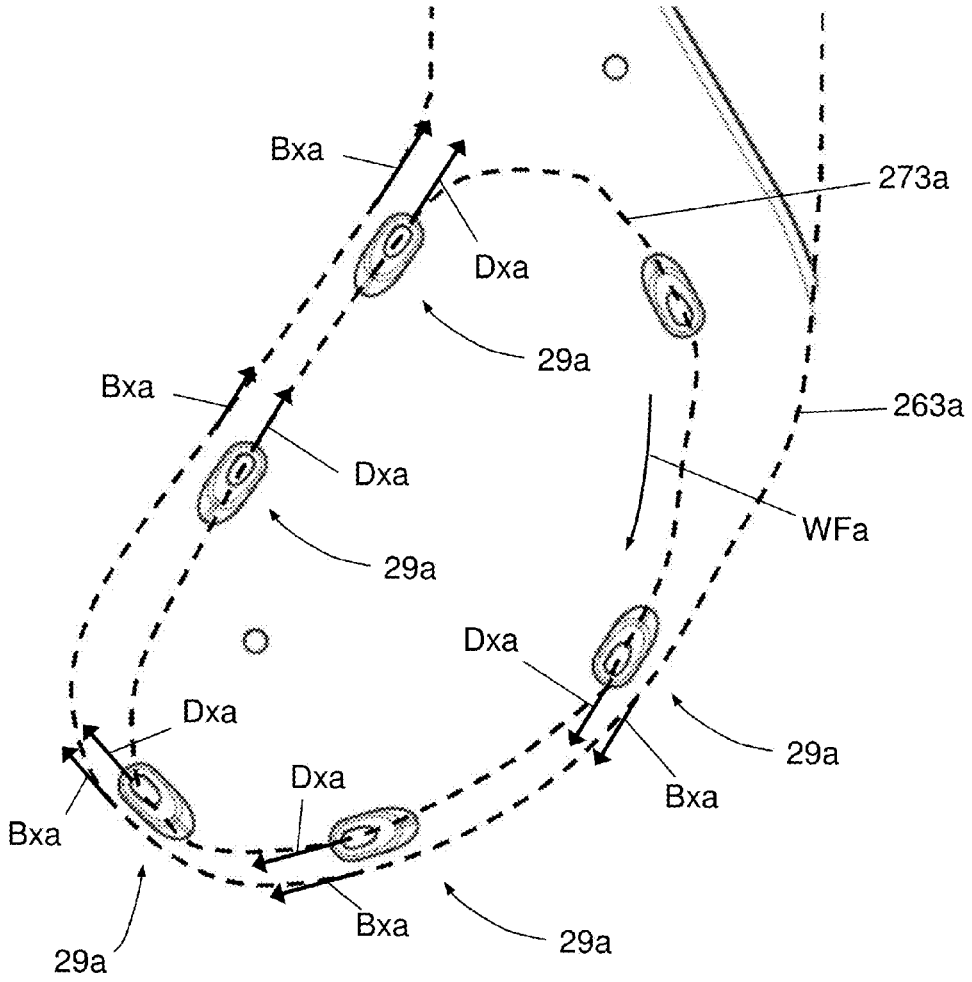
FIG. 11A shows an enlarged view of a particular of FIG. 11.

According to an advantageous aspect of the invention, outlets 29*a*, 29*b*, 29*c*, 29*d* of the water conveying line 120*a*, 120*b*, 120*c*, 120*d* are aligned along a path 273*a*, 273*b*, 273*c*, 273*d* which is at least partially adjacent to the top boundary line 263*a*, 263*b* 263*c*, 263*d* of the underlying compartment 23*a*, 23*b*, 23*c*, 23*d*, as visible in FIGS. 11 and 11A.

Advantageously, also the portion of the ducts 38*a*, 38*b*, 38*c* where the outlets 29*a*, 29*b*, 29*c*, 29*d* are realized follows a path which is at least partially adjacent to the top boundary line 263*a*, 263*b* 263*c*, 263*d* of the underlying compartment 23*a*, 23*b*, 23*c*, 23*d*.

For simplicity's sake, hereinafter we will refer only to outlets 29*a* of the first water conveying line 120*a*. It has to be noted that the same analogously applies to outlets 29*b*, 29*c*, 29*d* of other water conveying lines 120*b*, 120*c* and 120*d*.

The displacement of the outlets 29*a* along said path 273*a* allows the water falling into the underlying compartment 23*a* to firstly touch its side wall 63*a* and then to flow towards the bottom part 62*a* thereof.

Preferably, outlets 29*a* are opportunely shaped so that the water falls into the underlying compartment 23*a* along a water direction Da which tangentially follows the side wall 63*a* of the compartment 23*a*.

Preferably, the water direction Da of the water exiting the outlet 19*a* has a first component Dxa, or horizontal component Dxa, which is parallel to the horizontal direction Bxa of the adjacent top boundary line 263*a* at the point of said top boundary line 263*a* closest to outlet 19*a*, as illustrated in FIG. 11A. The horizontal direction Bxa of the top boundary line 263*a* at any point is defined to be the same as the direction of the line tangent to the top boundary line 263*a* at that point.

The horizontal component Dxa of the water direction Da is therefore substantially parallel to the side wall 63*a* of the compartment 23*a*, when viewed from above.

Figure 14:
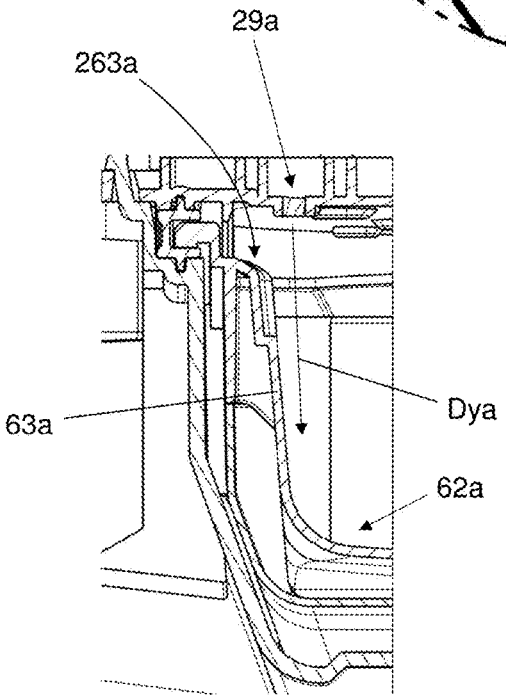
FIG. 14 shows a plan view of the treating agents dispenser of FIG. 10 sectioned along line XIV°-XIV°.

Preferably, the water direction Da has a second substantially vertical component Dya which tangentially follows the side wall 63*a*, as illustrated in FIG. 14. The second component Dya of the water direction Da is substantially parallel to the side wall 63*a*.

For the sake of simplicity, only outlets 29*a* of the first water conveying line 120*a* are described in detail hereinafter with reference to FIGS. 12 to 14. It has to be noted that the same applies to outlets 29*b*, 29*c*, 29*d* of other water conveying lines 120*b*, 120*c* and 120*d*.

Figure 12:
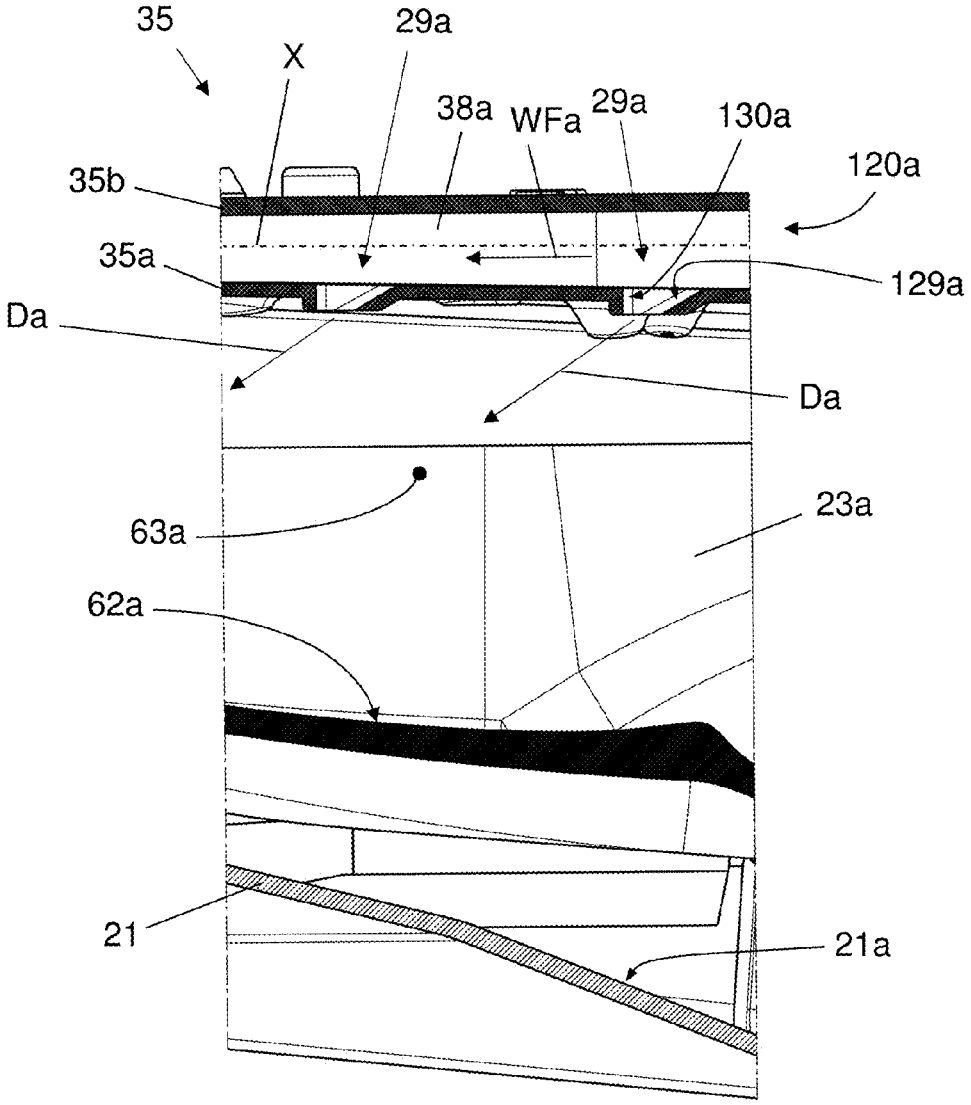
FIG. 12 shows a plan view of the treating agents dispenser of FIG. 10 sectioned along line XII°-XII°.
Figure 13:
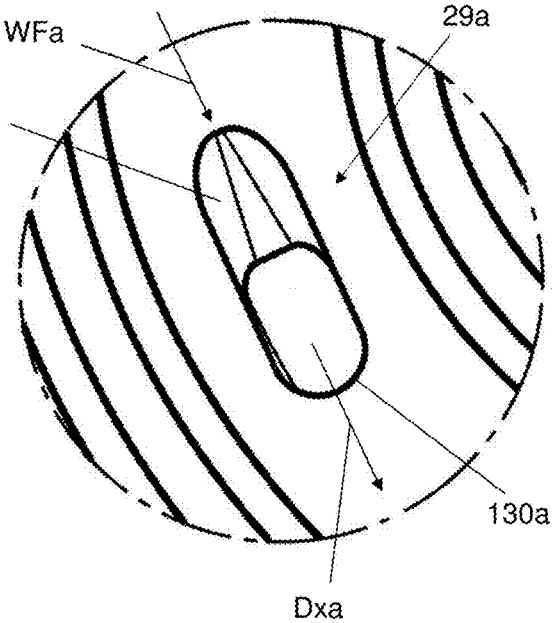
FIG. 13 shows an isometric enlarged view of a particular of FIG. 9.

FIG. 12 illustrates a section view of two of said outlets 29*a* of the first water conveying line 120*a*.

As said above, outlets 29*a* are realized along a portion of the duct 38*a* which defines the first water conveying line 120*a*. The duct 38*a* preferably extends along a main axis X.

Each outlet 29*a* preferably comprises an inclined upstream portion 129*a*. It is underlined that the term "upstream" is referred to as the flowing direction WFa of the water inside the first water conveying line 120*a* during the functioning of the water dispenser 20.

The inclined upstream portion 129*a* preferably diverges from the main axis X, i.e. the distance of the inclined upstream portion 129*a* from the main axis X increases while moving in said water flowing direction WFa.

The inclined upstream portion 129*a* advantageously contributes to convey the water along said water direction Da which tangentially follows the side wall 63*a* of the first compartment 23*a*.

In particular, the first component Dxa of the water direction Da and the second component Dya of the water direction Da tangentially follow the side wall 63*a* of the first compartment 23*a*.

Each outlet 29*a* then preferably comprises a straight downstream portion 130*a*. It is underlined that the term "downstream" is also referred to as the flowing direction WFa of the water inside the first water conveying line 120*a* during the functioning of the water dispenser 20.

Water falling down from the outlets 29*a* tangentially follows the side wall 63*a* of the first compartment 23*a* and falls down by gravity into the bottom 62*a* of the same. The water exiting the outlets 29*a* along said water direction Da generates controlled vortices inside the first compartment 23*a*.

With the term "controlled" it is meant that vortices generated by water falling along said water direction Da does not create undue turbulences, as it happens if the water strikes the wall of the compartment with an angle of incidence, i.e. does not tangentially follow the wall. Undue turbulences reduce the efficiency of the treating agent due to creation of foam.

Advantageously, when the first compartment 23*a* is filled with a treating agent, for example powder detergent, the water gently drags the treating agent towards the bottom 62*a* of the first compartment 23*a* and from there towards the rear aperture 26. Furthermore, once all the treating agent has been conveyed towards the rear aperture 26, the water falling down from the outlets 29*a* and vortices generated therefrom advantageously clean the first compartment 23*a* and no products accumulate at the side wall 63*a* and/or bottom part 62*a* of the first compartment 23*a*.

This guarantees good hygienic conditions inside the first compartment 23*a*, in particular when the laundry washing machine 1 is not used for a long time between two successive washing cycles.

According to a further advantageous aspect of the invention, outlets 29*a* are arranged along the first water conveying line 120*a* so that at least a quantity of water exiting the outlets 29*a* along the water direction Da is directed towards the curved portion 163*a* of the underlying first compartment 23*a*.

The combined effect of the water exiting the outlets 29*a* along said water direction Da and the curvature of the curved portion 163*a* enhances the generation of controlled vortices inside the first compartment 23*a*.

Again, advantageously, vortices avoids accumulation of products at the side wall 63*a* and/or bottom part 62*a* of the first compartment 23*a*.

The cleaning effect for the treating agent dispenser 20 is therefore increased.

Furthermore, vortices advantageously enhance the dissolution of the treating agent in the water.

Analogously, the same cleaning and/or dissolution effects for the other compartments 23*b*, 23*c*, 23*d* are obtained through outlets 29*b*, 29*c* and 29*d* and their displacement in the respective water conveying lines 120*b*, 120*c* and 120*d* with respect to the curved portions 163*b*, 163*c* and 163*d* of the compartments 23*b*, 23*c* and 23*d*.

In the preferred embodiment above described, each outlet of the plurality of outlets has the particular shape as described in detail above.

Nevertheless in further preferred embodiments, not all the outlets along said path may be shaped. Along said path a small number of different outlets may be present, for example a small number of standard cylindrical outlets.

Advantageously the treating agents dispenser 20 also preferably comprises a by-pass line 50, better visible in FIG. 11.

The by-pass line 50 comprises a conduit portion 51, obtained in a region of the water distributor 35 not interested by the ducts 38*a*, 38*b* and 38*c*. The conduit portion 51 is opportunely fluidly separated from the compartments 23*a*, 23*b*, 23*c* e 23*d* and terminates with an opening 53, shown in FIG. 11, facing the underlying housing 21. The opening 53 is placed above the drawer 22 in such a way to allow the flowing of water directly to the bottom 21*a* of the housing 21 and outside the compartments 23*a*, 23*b*, 23*c*, 23*d* without entering the compartments 23*a*, 23*b*, 23*c*, 23*d*.

The conduit portion 51 communicates with an inlet connector 36*e* of the water distributor 35. The inlet connector 36*e* is fluidly connected, via a controllable valve 40*e*, to the water source E.

Inlet of the controllable valve 40*e* is connectable to the water source E and outlet of the controllable valve 40*e* is connected, through a respective pipe 34*e*, to the inlet connector 36*e*.

The by-pass line 50 is adapted to allow the passage of clean (or fresh) water from the water source E directly to the washing tub 3 by-passing the compartments 23*a*, 23*b*, 23*c*, 23*d* of the water distributor 35.

In different embodiments the by-pass line may not be present.

Hereinafter, a possible functioning of the the treating agents dispenser 20 during a laundry washing cycle is described.

The first compartment 23*a* of the treating agents dispenser 20 is filled with powder detergent or the second compartment 23*b* is filled with liquid detergent. Then, advantageously, the third compartment 23*c* may be filled with a softener and/or the fourth compartment 23*d* may be filled with other treating agents, such as fabric conditioners, waterproofing agents, fabric enhancers, rinse sanitization additives, chlorine-based additives, etc. By operating on the interface unit 16 the user selects the desired washing program. The control unit 11 controls the laundry washing machine 1 so that it may start the washing program and dispensing, when required, the proper treating agent from the treating agents dispenser 20 to the washing tub 3.

The treating agent is dispensed from the treating agents dispenser 20 to the washing tub 3 by making flow an amount of flushing water into the proper compartment so as to flush out the treating agent contained therein and convey it into the washing tub 3 through the outlet port 24 and the supply pipe 18, for example as illustrated in FIGS. 9A, 9C o 9D.

For example, the powder detergent is dispensed from the treating agents dispenser 20 to the washing tub 3 by making flow an amount of flushing water into the first compartment 23*a* so as to flush out the powder detergent contained therein and convey it into the washing tub 3 through the outlet port 24 and the supply pipe 18.

Advantageously and according to what previously described, during said phase of the washing cycle the cleaning and/or the dissolution effect is advantageously obtained.

The washing cycle may then proceed with the following phases, such as water heating, drum rotation, draining phases, spinning cycles, etc., or further water loads.

It has thus been shown that embodiments of the present invention allow the set objects to be achieved. In particular, it is possible to realize a laundry washing machine that makes it possible to reduce or prevent residues of treating agent from adhering on the walls of compartments of the treating agents dispenser.

It is underlined that the laundry washing machines illustrated in the enclosed figures are of the front-loading type; however it is clear that the system according to the invention can be applied as well to a top-loading washing machine, substantially without any modification.

While the present invention has been described with reference to a particular embodiment shown in the figures, it should be noted that the present invention is not limited to the specific embodiments illustrated and described herein; on the contrary, further variants fall within the scope of the present invention, which is defined in the claims.

The invention claimed is:

1. A laundry washing machine comprising:

a) a cabinet supporting a washing drum adapted to receive laundry and a washing tub external to said washing drum;

b) a treating agents dispenser comprising:

1) a drawer having at least one compartment adapted to be filled with at least one treating agent, said at least one compartment comprising a bottom part and a side wall rising from said bottom part, said side wall superiorly defining a top boundary line;

2) a housing positioned above said drawer, the housing having at least one water conveying duct positioned above said side wall of said at least one compartment for conveying water to said at least one compartment;

c) a supply line, fluidly connecting said treating agents dispenser and said washing tub;

d) a control unit for controlling functioning of said laundry washing machine;

wherein said at least one water conveying duct comprises outlets having an inclined portion extending from the duct to a position facing said at least one compartment, said outlets being aligned along a path and being at least partially adjacent to said top boundary line directing said water to flow through said outlets along a water direction having a horizontal component tangentially following said side wall of said at least one compartment.

2. A machine according to claim 1, wherein said outlets are aligned along said path so that the water falling into said compartment touches said side wall and then flows towards said bottom part.

3. A machine according to claim 1, wherein said water direction having said horizontal component is parallel to said side wall.

4. A machine according to claim 1, wherein said water direction has a substantially vertical component which tangentially follows said side wall.

5. A machine according to claim 1, wherein the vertical component of said water direction is substantially parallel to said side wall.

6. A machine according to claim 1, wherein said water direction having said horizontal component is parallel to the horizontal direction of said top boundary line at the point of said top boundary line closest to said one outlet.

7. A machine according to claim 1, wherein said outlets are realized along a portion of a duct which defines said at least one water conveying line.

8. A machine according to claim 7, wherein at least one of said outlets comprises an inclined upstream portion.

9. A machine according to claim 1, wherein each of said outlets comprises an inclined upstream portion.

10. A machine according to claim 8, wherein said inclined upstream portion diverges from the axis of said duct.

11. A machine according to claim 1, wherein said side wall is vertical or substantially vertical, with the dispenser in its operating position in the laundry washing machine.

12. A machine according to claim 1, wherein said compartment comprises at least one curved portion.

13. A machine according to claim 12, wherein said outlets of said at least one water conveying line are arranged along so that at least a quantity of water exiting said outlets is directed towards said curved portion.

* * * * *